US008529306B2

(12) United States Patent
Baldwin

(10) Patent No.: US 8,529,306 B2
(45) Date of Patent: Sep. 10, 2013

(54) DEVICE FOR PEDAL POWERING A WATERCRAFT

(76) Inventor: Aaron Leland Baldwin, McClellanville, SC (US)

( * ) Notice: Subject to any disclaimer, the term of this patent is extended or adjusted under 35 U.S.C. 154(b) by 183 days.

(21) Appl. No.: 13/199,706

(22) Filed: Sep. 7, 2011

(65) Prior Publication Data

US 2012/0058693 A1 Mar. 8, 2012

Related U.S. Application Data

(60) Provisional application No. 61/402,792, filed on Sep. 7, 2010.

(51) Int. Cl.
*B63H 1/30* (2006.01)

(52) U.S. Cl.
USPC ..... 440/13

(58) Field of Classification Search
USPC ..... 440/12.5, 12.62, 13
See application file for complete search history.

(56) References Cited

U.S. PATENT DOCUMENTS

| | | | | | |
|---|---|---|---|---|---|
| 427,842 | A * | 5/1890 | Dice et al. | 440/19 |
| 2,213,538 | A * | 9/1940 | Whitehead | 416/74 |
| 3,225,733 | A * | 12/1965 | Schwarzer | 440/30 |
| 3,371,635 | A * | 3/1968 | Seeley | 114/330 |
| 4,936,802 | A * | 6/1990 | Ueno | 440/13 |
| 5,460,551 | A * | 10/1995 | Beres | 440/27 |
| 6,022,249 | A * | 2/2000 | Ketterman | 440/13 |
| 7,637,791 | B2 * | 12/2009 | Ketterman et al. | 440/13 |
| 8,082,871 | B2 * | 12/2011 | Czarnowski et al. | 114/345 |
| 2005/0106954 | A1 * | 5/2005 | Gardner | 440/27 |
| 2009/0215339 | A1 * | 8/2009 | Detweiler | 440/94 |
| 2012/0276792 | A1 * | 11/2012 | Martino | 440/13 |

* cited by examiner

*Primary Examiner* — Stephen Avila

(57) ABSTRACT

The present invention is a device affording foot-powered propulsion of a watercraft by an occupant. The device consists of two levers, each with a shaft, serving as a fulcrum. When mounted on a host craft the force arms extend above the deck or floor of the vessel and each has a pedal attached to their end. The resistance arms extend beneath the hull of the craft and each has a folding paddle attached. The levers are linked so that pushing one pedal away from the operator forces the other pedal towards the operator. A back-and-forth pedaling motion moves the folding paddle blades, propelling the vessel. Direction of propulsion can be reversed by rotating the paddles 180 degrees. The invention is intended to be mounted to a watercraft, such as, a kayak that has been specifically designed for or altered to accept the device.

14 Claims, 7 Drawing Sheets

DEVICE FOR PEDAL POWERING A WATERCRAFT

CROSS-REFERENCE TO RELATED APPLICATIONS

This application claims priority to provisional application No. 61/402,792 filed on Sep. 7, 2010.

STATEMENT REGARDING FEDERALLY SPONSORED RESEARCH AND DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to the propulsion of watercraft and specifically to an apparatus to be mounted to accommodating watercraft that will allow for pedal powered propulsion by an occupant.

Various means of occupant-powered watercraft have been proposed and utilized in the past. Paddles driven by hand, including those with folding blades, such as the device described in U.S. Pat. No. 427,842, have been around for many years. More recently, foot-driven, pedal systems have gained in popularity as boaters have come to appreciate the advantages of having their hands free for activities, such as, fishing. The typical superiority of an operator's leg strength over arm strength is another reason for the appeal of pedal systems.

Many previously proposed and existing devices for pedal driving watercraft rely on a circular pedal motion like that used to propel bicycles. U.S. Pat. No. 5,460,551 describes a pedal driven watercraft that requires pedals to be driven in such a revolving path. For the operator of a small watercraft, such as, a kayak this circular motion may produce discomfort due to the relative distance between a given pedal's nearest and furthest points to the operator's torso during a revolution. Many of these designs also require chains, or extended drive shafts to transfer motion to a propulsive element.

The device described in U.S. Pat. No. 6,022,249 requires less of an extension of the operator's legs, but lacks the desirable feature of being able to reverse the direction of the propulsion.

BRIEF SUMMARY OF THE INVENTION

The present invention relates to occupant powered propulsion of a watercraft, and specifically to a pedal driven apparatus that may be mounted to vessels, such as, kayaks that have been specifically designed or altered to accommodate the device.

The present invention creates propulsion by providing a means by which the leg motion of an occupant can move paddles with hinged blades, below the waterline. For the purposes of this document the paddles with hinged blades will be referred to as folding paddles.

Folding paddles are configured so that they fold shut, producing minimal resistance when moving in the direction of travel of a host watercraft and open when moving opposite the direction of travel of a host watercraft, thus providing thrust.

The preferred embodiment employs two levers to convert the leg movement of the occupant to propelling thrust. (For the purposes of this document, the term, "operator," may be used interchangeably with the term, "occupant.") Each of the two levers has a foot pedal mounted to the end of its force arm, and a folding paddle mounted to the end of its resistance arm.

For each lever the pivot point or fulcrum is provided by a shaft running through a bushing attached to a common mounting plate. Near the center of the mounting plate the two shafts, lying parallel are connected by meshed gears so that the rotation of one shaft creates an equal counter-rotation in the other.

When properly mounted to a vessel the mounting plate is attached to a deck, floor, or similarly horizontal, structural plane of the craft at a level above the waterline. Two parallel slots penetrating the hull are required to allow the levers to reach from above to below the level of the waterline. The upper rim of the slots must be above the water line to prevent the vessel from taking on water.

The device is intended to be mounted on the longitudinal centerline between the bow and the occupant's seat, at a distance from the seat that will allow for a comfortable, back-and-forth pedaling motion by the occupant.

When force is applied to a given pedal it will travel roughly 120 degrees in an arc from its closest to furthest point from the operator. As a given pedal moves away from the operator, its corresponding folding paddle is open and moving towards the operator, below the water line, creating thrust. Simultaneously, the other pedal is being brought back towards the operator and its paddle is folded and moving away from the operator.

Repetition of the movement described above propels the host craft through the water in a forward direction.

A hinged connection between each lever and its fulcrum or shaft allows the lever arms to be rotated 180 degrees. The occupant can flip the pedals with his or her feet, rotating the folding paddle blades. With the paddles facing in the opposite direction, the same back-and-forth pedal motion will move the craft in reverse.

Since maintaining a low center of gravity is desirable in many small types of watercraft, pedaling from a recumbent position is often a necessity in pedal driven watercraft. The back-and-forth motion applied toward the present invention requires less leg reach than revolving, bicycle-type pedals.

DETAILED DESCRIPTION OF THE INVENTION

Figure 9:
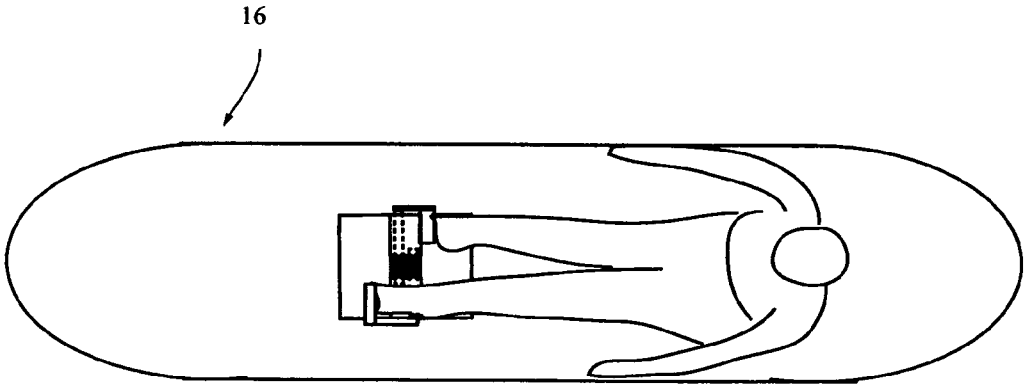
FIG. 9 is a plan of the embodiment of FIG. 1 as mounted on a host watercraft with an occupant.

Turning to the drawings, it is important to note that when properly mounted to a host craft 16 as in FIG. 9 the present invention is mostly symmetrical across the center line, between port and starboard, allowing distinction to be made between like parts based upon their location relative to the host craft.

Figure 1:
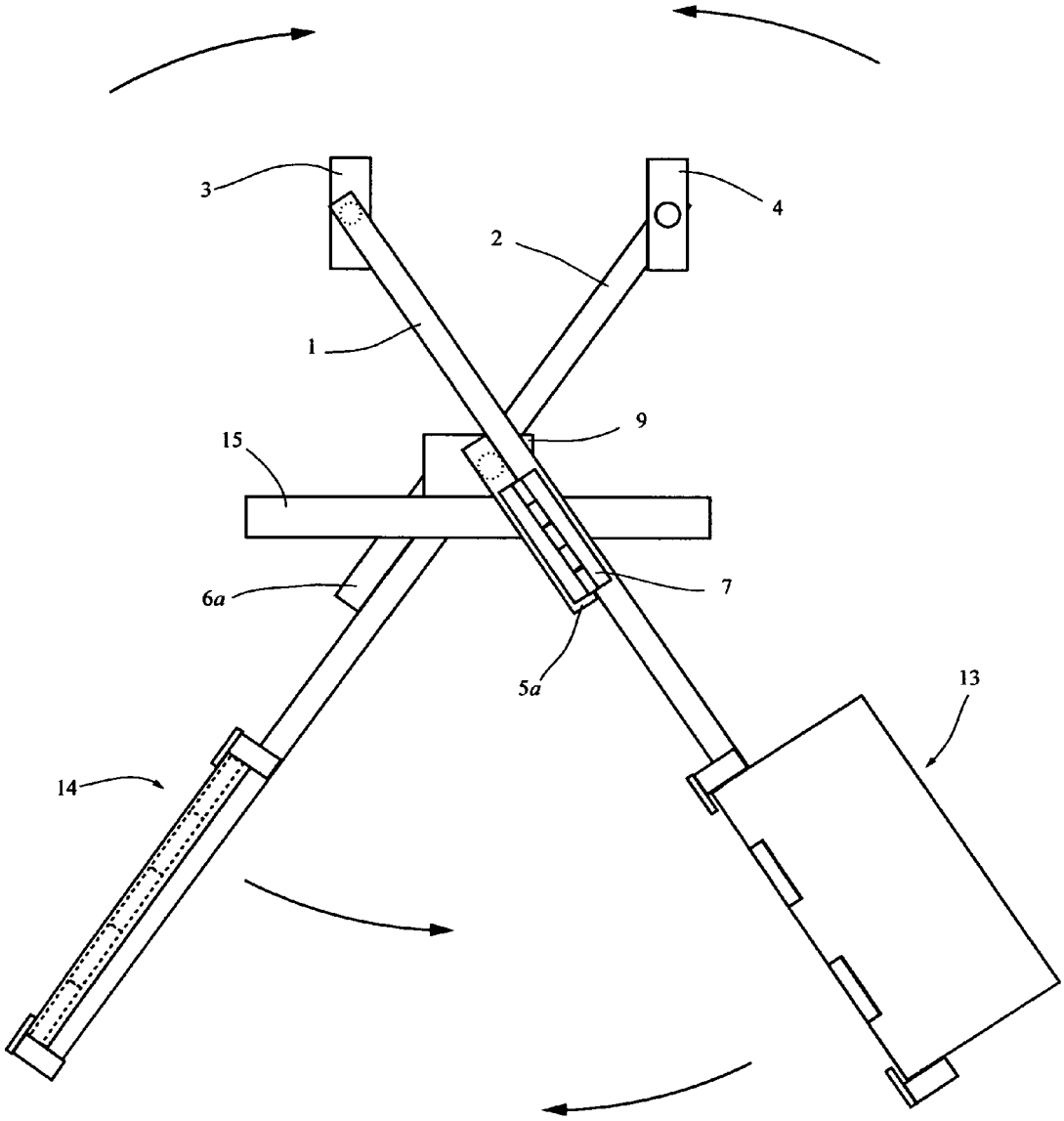
FIG. 1 is a port side elevation of one embodiment of the present invention with components configured for forward propulsion. Arced arrows indicate the direction of movement of pedals and folding paddles.

Referring to the drawings, the present invention relates to a pedal powered propulsion device for a watercraft comprised of first-class levers, port 1 and starboard 2, rotatable shafts, port 5 and starboard 6, shaft extensions port 5*a* and starboard 6*a*, folding paddles, port 13 and starboard 14, rotatable pedals port 3 and starboard 4, hinges, port 7 and starboard 8, bushings, port 9 and starboard 10, gears, aft 11 and fore 12 and a mounting plate 15, FIG. 1 shows a port side elevation, of the preferred embodiment, with pedals 3 and 4 and folding paddles 13 and 14 oriented for forward propulsion of a host craft.

Figure 3:
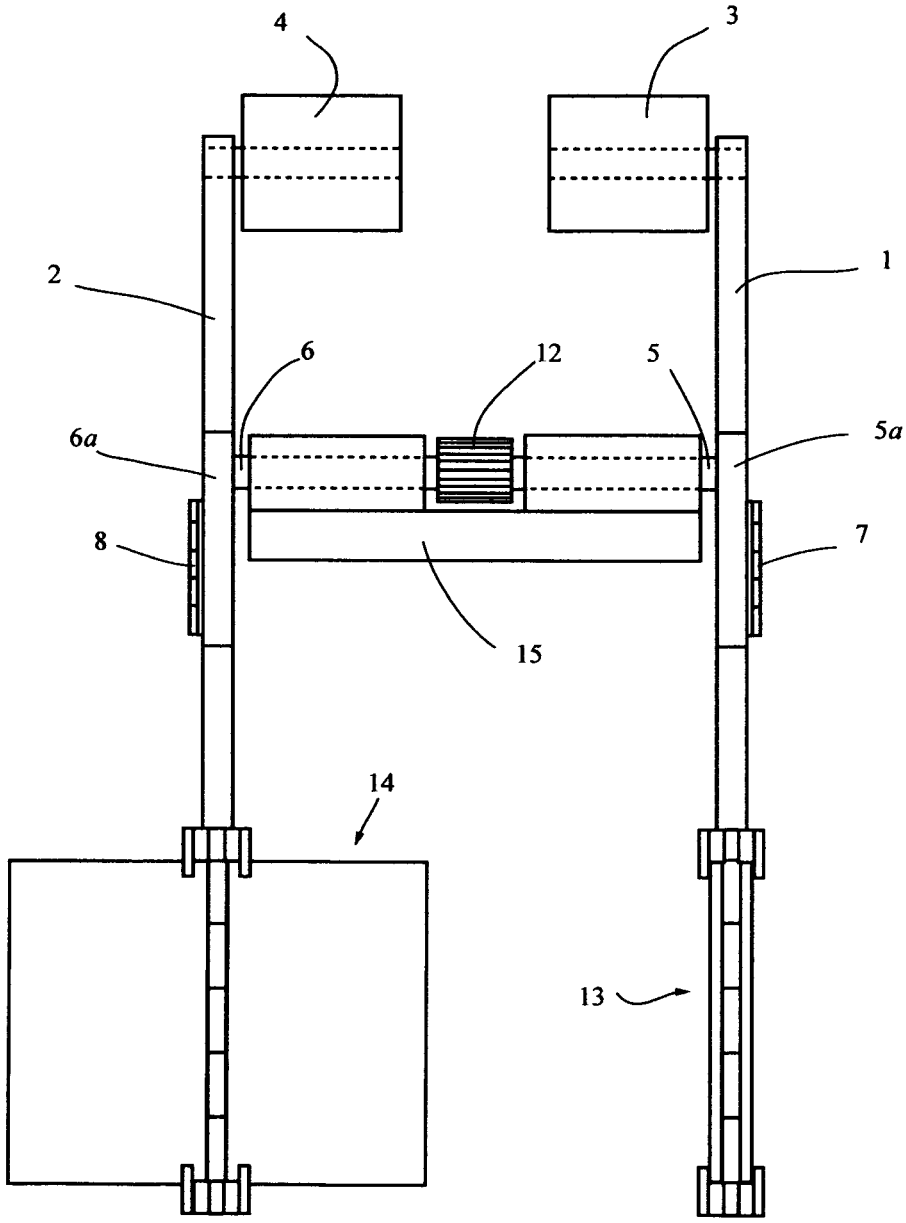
FIG. 3 is a bow elevation of the embodiment of FIG. 1 with components configured for forward propulsion.

FIG. 3 represents a front elevation, of the preferred embodiment with the orientation of the pedals and folding paddles indicative of forward motion of the host craft.

In FIG. 3 it can be seen that the port shaft 5 and starboard shaft 6, mounted in bushings 9 and 10 act as fulcrums for their respective levers; each lever having resistance arms extending in generally downward directions from, their respective shafts and force arms extending in generally upward directions from their respective shafts.

Figure 5:
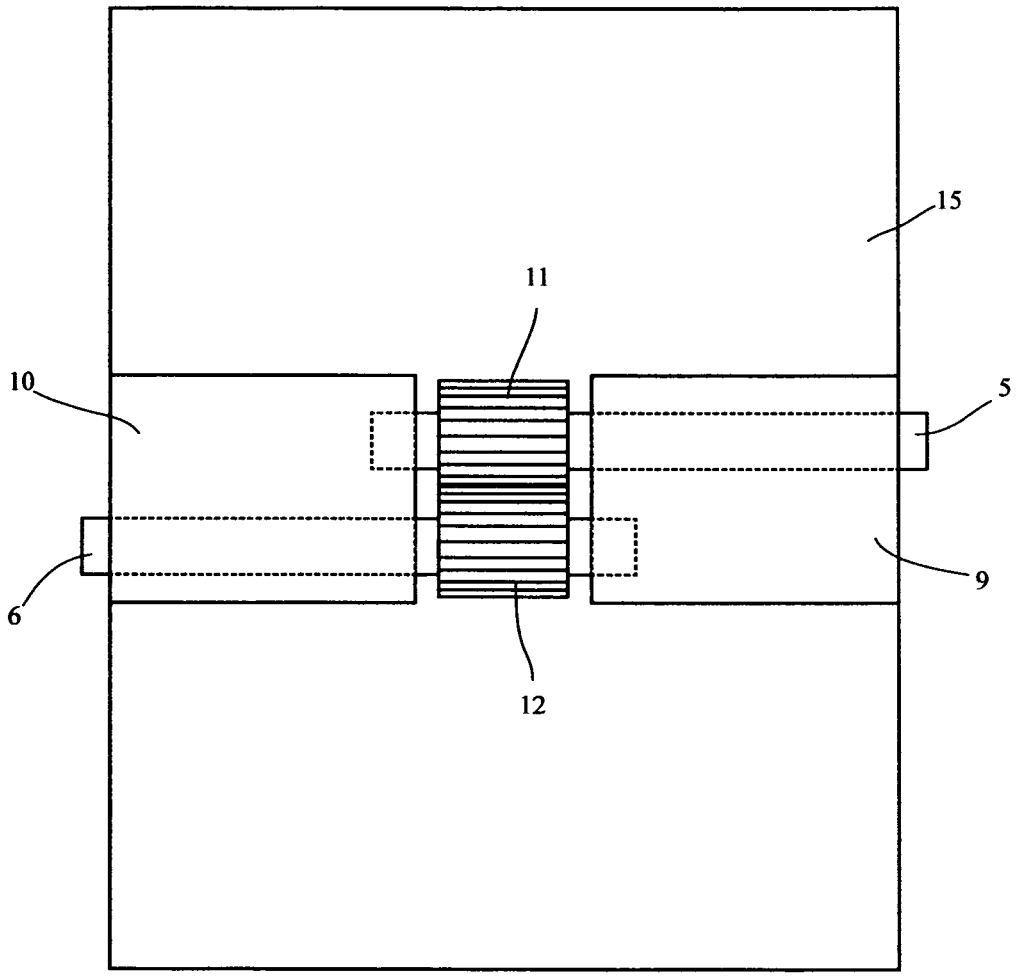
FIG. 5 is a partial plan detail of the embodiment of FIG. 1 showing the arrangement of shafts, gears, bushings and mounting plate. Pedals, levers, lever extensions, and folding paddles have been omitted to lend visual clarity.

In the plan detail of FIG. 5 it can be seen that shaft 5 has a gear 10 mounted at a point near the center of the mounting plate 15 and that shaft 6 has a gear 12 mounted at a point near the center of the mounting plate 15. The two gears are meshed forming a simple gear train.

The relative angles of the port lever 1 and starboard lever 2 at their terminal points of travel is locked by the simple gear train described above and depicted in the plan detail, FIG. 5.

Taken together FIG. 1 and FIG. 3 provide clear illustration of the orientation of parts of the invention when configured for forward propulsion. It can be seen that the first-class levers 1 and 2 are hinged to and align themselves behind the 90 degree shaft extensions 5*a* and 6*a* and that the rotatable pedals 3 and 4 mounted at 90 degrees to the levers, project in towards one another.

Figure 6:
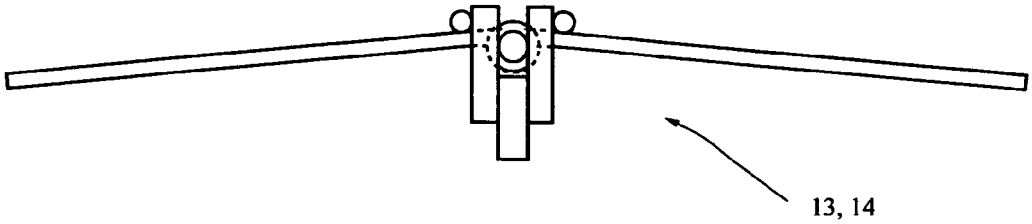
FIG. 6 is a detail plan of a folding paddle of the embodiment of FIG. 1 in an open, propulsive configuration.
Figure 7:
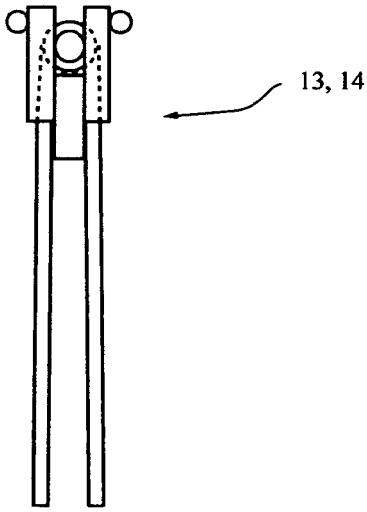
FIG. 7 is a detail plan of a folding paddle of the embodiment of FIG. 1 in a closed, streamlined configuration.
Figure 8:
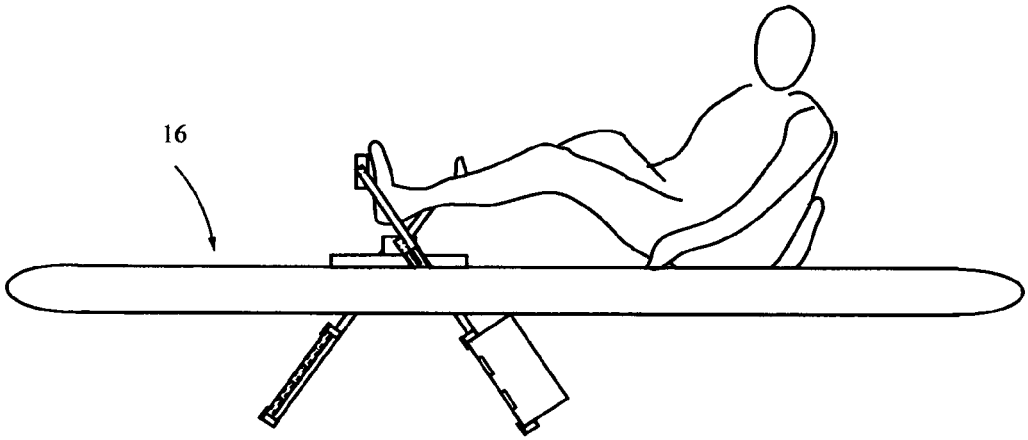
FIG. 8 is a port elevation of the embodiment of FIG. 1 as mounted on a host watercraft with an occupant.

FIGS. 1 and 3 also depict the configuration of folding paddles 13 and 14. In FIG. 1 and in FIG. 3 the port folding paddle 13 is depicted as open and the starboard folding paddle 14 is depicted as closed. Given the indicated direction of travel in FIG. 1 it should be evident that the open configuration of a folding paddle as represented in the plan detail FIG. 6 provides the thrust that propels the host watercraft, while the folded configuration represented in plan detail in FIG. 7 presents minimal resistance through the water as a folding paddle moves in the direction of travel of a host craft 16.

Given the orientation of comprising parts illustrated in the figures described above the following manner of operation for forward propulsion can be understood:

Taking the orientation of parts in FIG. 1 as a beginning point, pressure applied by an operator's foot to the starboard pedal 4 in a direction towards the bow will result in a number of simultaneously occurring actions related to the desired function of the invention.

On the starboard side of the device the force arm of the starboard lever 2 with attached pedal 4 will move in an arcuate path toward the bow of the host craft, while the resistance arm of the starboard lever 2 with attached folding paddle 14 will move in an arcuate path toward the stem of the host craft. Given the direction of movement of the starboard folding paddle 14 relative to the location of the hinged edge of said paddle, the resulting water pressure will force open the blades forming a propulsive orientation.

In the center portion of the device, the counter-clockwise motion of the starboard shaft 6 is converted to clockwise rotation in port shaft 5 by the gear train created by the meshed gears 11 and 12.

On the port side of the device the force arm of the port lever 1 with attached pedal 3 will travel in an arcuate path towards the stem, driven by the force applied to starboard pedal 4, transferred and reversed in the gear train as described above. The resistance arm of the port lever 1 with attached folding paddle 13 will travel in an arcuate path toward the bow with the resulting water pressure forcing closed the blades of the paddle, creating a streamlined orientation.

When the starboard pedal 4 reaches its predetermined, terminal point of travel, pressure is applied to port pedal 3, making folding paddle 13 the thrust paddle and folding paddle 14 the passive, streamlined paddle.

Repetition of the action described above propels a host craft in a forward direction through the water.

Figure 4:
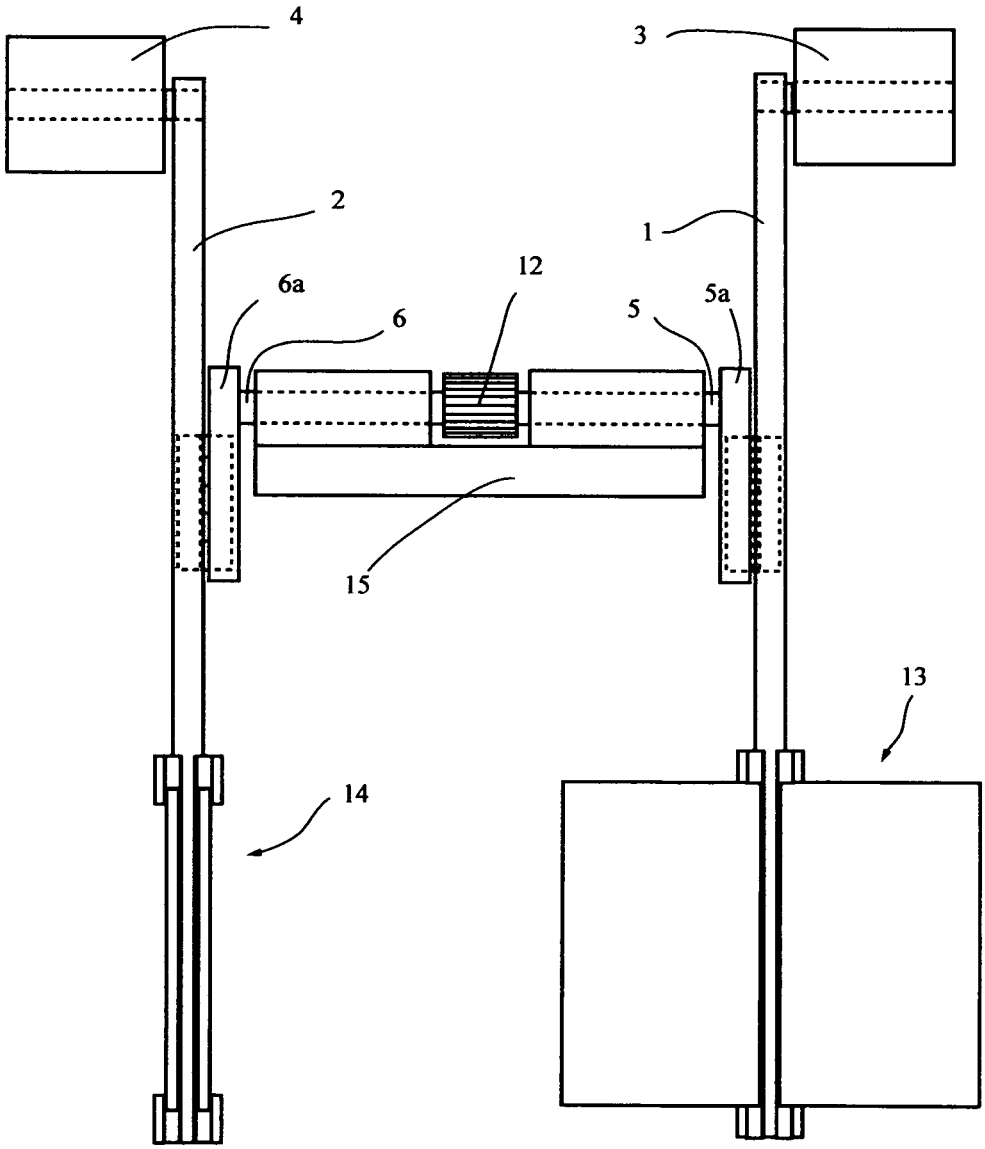
FIG. 4 is a bow elevation of the embodiment of FIG. 1 with components configured for reverse propulsion.

Reverse propulsion is achieved by changing the orientation of the pedals from pointing in towards one another as in FIG. 3 to pointing in opposite directions as seen in FIG. 4. This alteration can be achieved by the operator using feet or hands.

Figure 2:
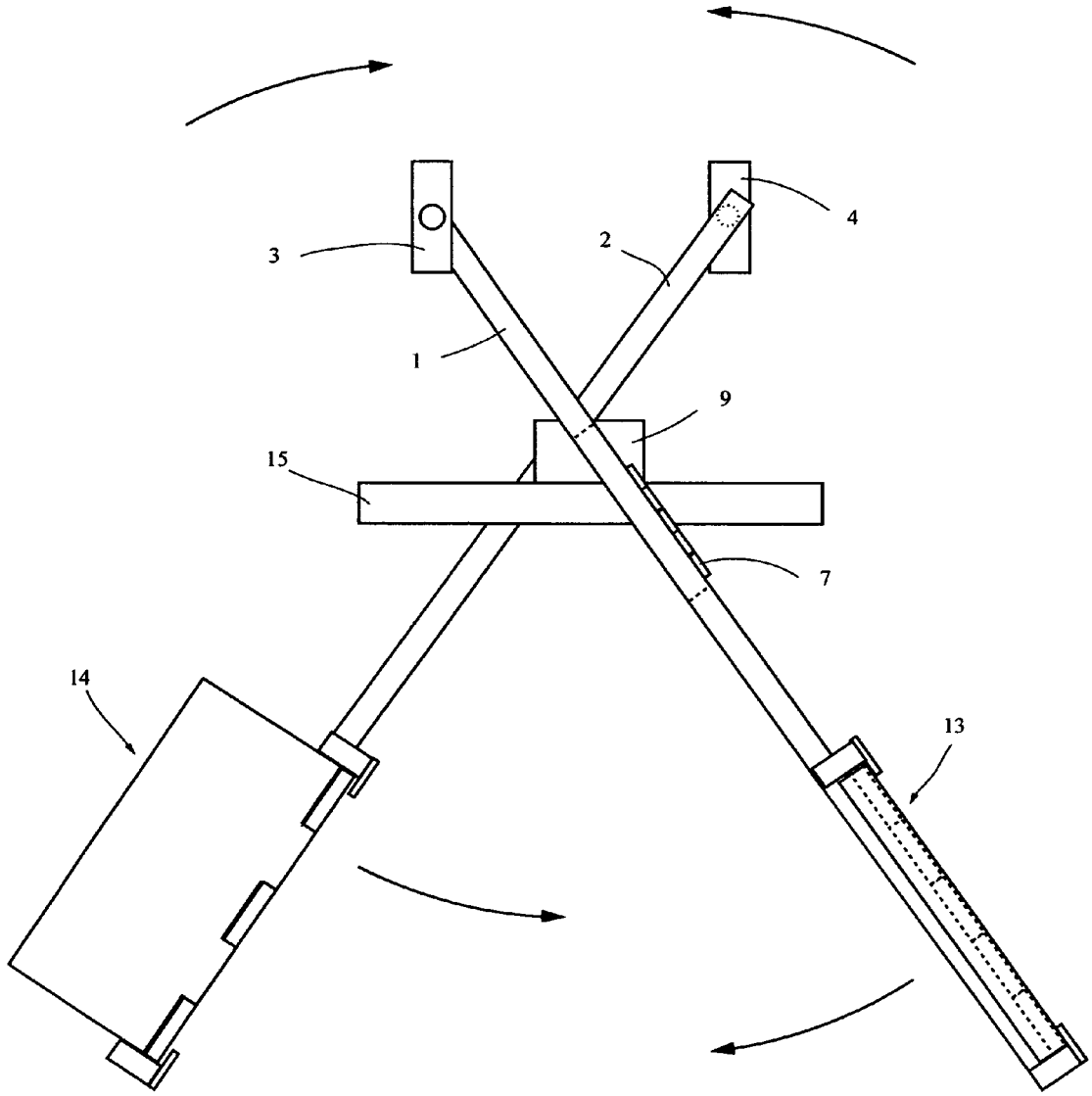
FIG. 2 is a port side elevation of the embodiment of FIG. 1 with components configured for reverse propulsion. Arced arrows indicate the direction of movement of pedals and folding paddles.

The port side elevation in FIG. 2 and the front elevation of FIG. 4 show the preferred embodiment, with pedals 3 and 4 and folding paddles 13 and 14 oriented for reverse propulsion of a host craft.

It can also be seen in FIG. 2 and in FIG. 4 that the levers 1 and 2 fall along side of their respective shaft extensions 5*a* and 6*a* when configured for reverse propulsion.

Since the rotating pedals 3 and 4 are fixed to the levers 1 and 2 and the levers 1 and 2 are connected to the shaft extensions 5*a* and 6*a* with hinges 7 and 8, flipping the orientation of the pedals 3 and 5 by 180 degrees also flips the direction of the folding paddles 13 and 14 by 180 degrees. With the leading edge of each folding paddle 13 and 14 facing the stern of the host craft 16 pressure applied to the pedals will propel a host craft in a reverse direction.

While a preferred embodiment of the present invention has been described in some detail above, it should be understood by those skilled in the art that other configurations of similar elements could be applied without departing from the spirit or scope of the present invention. The present invention is not limited except as by the appended claims.

What I claim as my invention is:

1. A pedal powered propulsion device for a watercraft; said device to be mounted to an accommodating watercraft constructed with at least one trunk or deck opening, so as to accept said device, said device employing the foot power of an operator to move a pair of folding paddles in an arcuate path beneath the surface of the water from the direction of the bow toward the direction of the stern and back, creating a propelling thrust; said propulsion device comprised of:

two first-class levers, each having a folding paddle attached to said lever's resistance arm and a rotatable foot pedal attached to said lever's force arm;

two rotatable shafts; said shafts serving as the fulcrums for said levers; each of said shafts having a toothed gear mounted toward one end of said shaft and one of said levers connected with a hinge to the opposite end of said shaft;

a rigid mounting plate with bushings fixed to or cast as part of said mounting plate; said bushings having bores to accept said shafts; said bores running in a generally horizontal fashion perpendicular to the longitudinal centerline between port and starboard of the host watercraft, when the mounting plate is properly mounted; said bores oriented relative to one another so as to create a simple gear train, having said shafts assembled into said bores with said gears meshed near the center of said mounting plate and each of said levers suspended just beyond the respective outer edges of said mounting plate.

2. The pedal powered propulsion device for a watercraft of claim 1 in which said mounting plate is secured to the floor, the deck, or similarly horizontal structural surface of said watercraft at a location along the longitudinal centerline between port and starboard sides of said watercraft and at a predetermined point between said operator and the bow of said watercraft.

3. The pedal powered propulsion device for a watercraft of claim 2 in which said watercraft includes, at least, one trunk or similar opening at the desired placement location of said propulsion device; said trunk or opening constructed so as to allow for the full, uninhibited operation of said propulsion device without allowing excessive amounts of water to enter the hull of said watercraft.

4. The pedal powered propulsion device for a watercraft of claim 2 in which said mounting plate is formed with contours and voids necessary for accepting fasteners and hardware for securing said mounting plate to said watercraft.

5. The pedal powered propulsion device for a watercraft of claim 1 in which resistance arms of said levers travel through said trunk or said deck opening, extending below the level of said watercraft's waterline, and force arms of said levers extend above the level of said watercraft's waterline.

6. The pedal powered propulsion device for a watercraft of claim 1 in which each of said levers has one of said pedals mounted perpendicularly, near the top of said lever's force arm; each of said pedals oriented in an opposite direction from the other said pedal with each of said pedals faces open towards said operator.

7. The pedal powered propulsion device for a watercraft of claim 1 in which each of said levers has one of said folding paddles mounted, near the bottom of said lever's resistance arm.

8. The pedal powered propulsion device for a watercraft of claim 7 in which folding paddles are comprised of:

two approximately flat blades of rigid or semi flexible material of similar predetermined size and shape; said pieces joined along a leading edge by a hinge or similarly flexible connection that will allow said blades to swing, as much as, 90 degrees around said hinge or flexible connection relative to the direction of travel of said watercraft;

a stop to prevent said blades from traveling beyond 90 degrees relative to the direction of travel of said watercraft.

9. The pedal powered propulsion device for a watercraft of claim 1 in which each of said shafts is fabricated so as to include a fixed shaft extension of predetermined length extending beyond said shaft's outer end in a direction approximately 90 degrees to the direction of said shaft.

10. The pedal powered propulsion device for a watercraft of claim 1 in which each of said levers is connected with a hinge to one of said shaft extensions in such a manner as to allow said levers to flip 180 degrees around the axes of said hinges.

11. The pedal powered propulsion device for a watercraft of claim 1 in which said shafts are linked by a simple gear train ensuring that rotational motion in one of said shafts will result in rotation in the opposite direction in the other said shaft and ensuring that the relative angles of said levers at their terminal points of travel will be constant.

12. The pedal powered propulsion device for a watercraft of claim 1 in which said pedals and said folding paddles travel in arcuate paths back-and-forth between predetermined terminal points, generally along a line running from the bow to the stern of said watercraft wherein:

said folding paddles travel in generally opposite directions to said pedals to which said folding paddles share a common lever;

said pedals travel in generally opposite directions to one another.

13. The pedal powered propulsion device for a watercraft of claim 1 in which said folding paddles will fold shut into a streamlined configuration when traveling in the direction of said hinged edge and said folding paddles will open to a propulsive configuration when traveling in a direction opposite said hinged edge.

14. The pedal powered propulsion device for a watercraft of claim 1 in which said levers may be flipped 180 degrees around said hinge, reversing the direction of propulsion.

* * * * *